US005989357A

United States Patent [19]

Vilhauer, Jr. et al.

[11] Patent Number: 5,989,357

[45] Date of Patent: Nov. 23, 1999

[54] REMOTELY-CONTROLLABLE SELF-CLEANING ROOF GUTTER SYSTEM AND METHOD

[76] Inventors: Jacob E. Vilhauer, Jr., 3325 SW. 44th, Portland, Oreg. 97221; Allison L. Vilhauer, 1211 S. Quebec Way, #9-205, Denver, Colo. 80231

[21] Appl. No.: 08/984,480

[22] Filed: Dec. 1, 1997

Related U.S. Application Data

[63] Continuation-in-part of application No. 08/880,049, Jun. 20, 1997, abandoned.

[51] Int. Cl.[6] ..... B08B 9/00; E04D 13/00

[52] U.S. Cl. ..... 134/8; 134/8; 134/22.1; 134/104.1; 52/12

[58] Field of Search ..... 134/8, 22.1, 22.11, 134/22.12, 22.18, 34, 37, 104.1, 166 R; 52/11, 12, 16

[56] References Cited

U.S. PATENT DOCUMENTS

| | | | |
|---|---|---|---|
| 2,841,100 | 7/1958 | Moller | 52/12 |
| 3,420,378 | 1/1969 | Turner | 52/12 X |
| 3,740,787 | 6/1973 | Bowermaster | 52/12 X |
| 3,834,091 | 9/1974 | Dugan | 52/12 X |
| 3,977,135 | 8/1976 | Hunley, Jr. | 52/12 |
| 4,150,793 | 4/1979 | Russo | 239/532 |
| 4,182,497 | 1/1980 | Ferreira et al. | 239/532 |
| 4,238,866 | 12/1980 | Taylor | 15/23 |
| 4,303,348 | 12/1981 | O'Brien | 401/137 |
| 4,319,851 | 3/1982 | Arthur | 401/137 |
| 4,349,039 | 9/1982 | Egger | 134/167 C |
| 4,673,129 | 6/1987 | Kologiy | 239/532 |
| 4,745,709 | 5/1988 | Johnson | 52/11 X |
| 4,750,883 | 6/1988 | Drake | 401/137 |
| 4,978,241 | 12/1990 | Lawson | 401/118 |
| 5,022,586 | 6/1991 | Putnam | 239/71 |
| 5,274,965 | 1/1994 | Jackson | 52/12 |
| 5,536,406 | 7/1996 | Silva | 52/12 X |
| 5,586,837 | 12/1996 | Udelle | 52/12 X |
| 5,634,299 | 6/1997 | Gaston | 52/12 |

*Primary Examiner*—Jill Warden
*Assistant Examiner*—Saeed Chaudhry
*Attorney, Agent, or Firm*—Chernoff, Vilhauer, McClung & Stenzel

[57] ABSTRACT

A remotely-controllable self-cleaning roof gutter preferably has a selectively inflatable and deflatable bladder extending longitudinally along the interior of the roof gutter. The bladder has an interior chamber connected to a fluid conduit which extends downwardly from the gutter so that the inflation or deflation of the bladder can be controlled manually by a person standing on the ground. When the gutter is to be cleaned, the normally deflated bladder is inflated by introducing pressurized fluid into the conduit which causes the bladder to lift debris toward the top of the gutter and dump it over the top of the gutter onto the ground by gravity. Thereafter, the bladder is deflated and the gutter is restored to normal usage. Preferably, a fluid-permeable screening member is mounted immediately above the gutter drain and is liftable by the inflated bladder in unison with the debris so that debris surrounding the screening member is likewise removed by gravity.

18 Claims, 2 Drawing Sheets

REMOTELY-CONTROLLABLE SELF-CLEANING ROOF GUTTER SYSTEM AND METHOD

This is a continuation-in-part of U.S. Pat. application Ser. No. 08/880,049 filed Jun. 20, 1997 now abandoned.

BACKGROUND OF THE INVENTION

The present invention relates to a system for cleaning debris from roof gutters. More particularly, the invention relates to a remotely-controllable self-cleaning gutter system which can be operated from ground level quickly and with negligible effort.

Cleaning debris, such as leaves, twigs, evergreen needles, etc. from roof gutters normally requires climbing a ladder to the elevation of the gutter and performing the cleaning by hand. Such a task is dangerous, difficult and time-consuming, with the result that the task is often neglected causing gutter drains and their downspouts to become obstructed by debris. This in turn causes the gutters to overflow, resulting in water damage to buildings and landscaping.

Because of the dangerous and difficult nature of gutter cleaning by such conventional methods, many different pole-type gutter cleaning implements have been proposed to enable the user to remain on the ground while cleaning a gutter. However these devices are laborious and time-consuming to use, and are of questionable effectiveness particularly if a gutter contains a large amount of debris. Moreover, they are difficult or impossible to use for gutters located at relatively high elevations above the ground.

BRIEF SUMMARY OF THE INVENTION

The present invention is directed to a remotely-controllable self-cleaning roof gutter system which is operable from ground level and requires no laborious or time-consuming effort on the part of the user.

According to one aspect of the invention, a gutter is provided with at least one inflatable bladder. A fluid infusion conduit is connected to an interior chamber within the bladder to selectively inflate the normally deflated bladder by the infusion of pressurized fluid from a remote source when it is desired to clean the gutter. The inflation of the bladder lifts debris deposited within the gutter to a location at or near the top of the gutter where the debris is readily removable. Preferably, the fluid is supplied from an ordinary domestic water source, although other water or air sources could be used if desired.

Removal of the lifted debris can, within the scope of the invention, be accomplished in any of several ways while the bladder is inflated. These could, for example, include the ordinary forces of nature such as gravity, or the use of handheld water-spraying or air-blowing hoses or other conduits which the user could direct toward the lifted debris while standing at or near ground level. Preferably, the debris is removed merely by gravity so that it falls to the ground beneath the gutter without any effort by the user.

According to a separate aspect of the invention, the removal of the lifted debris is facilitated by an upwardly-movable debris-collecting and debris-lifting element within the gutter which could, alternatively, be a part of the bladder, an element mounted on the bladder, a separately mounted element liftable by the bladder, or an element liftable by a mechanism other than a bladder which would enable the bladder to be eliminated.

The foregoing and other objectives, features, and advantages of the invention will be more readily understood upon consideration of the following detailed description, taken in conjunction with the accompanying drawings.

DETAILED DESCRIPTION OF THE PREFERRED EMBODIMENT

Figure 1:
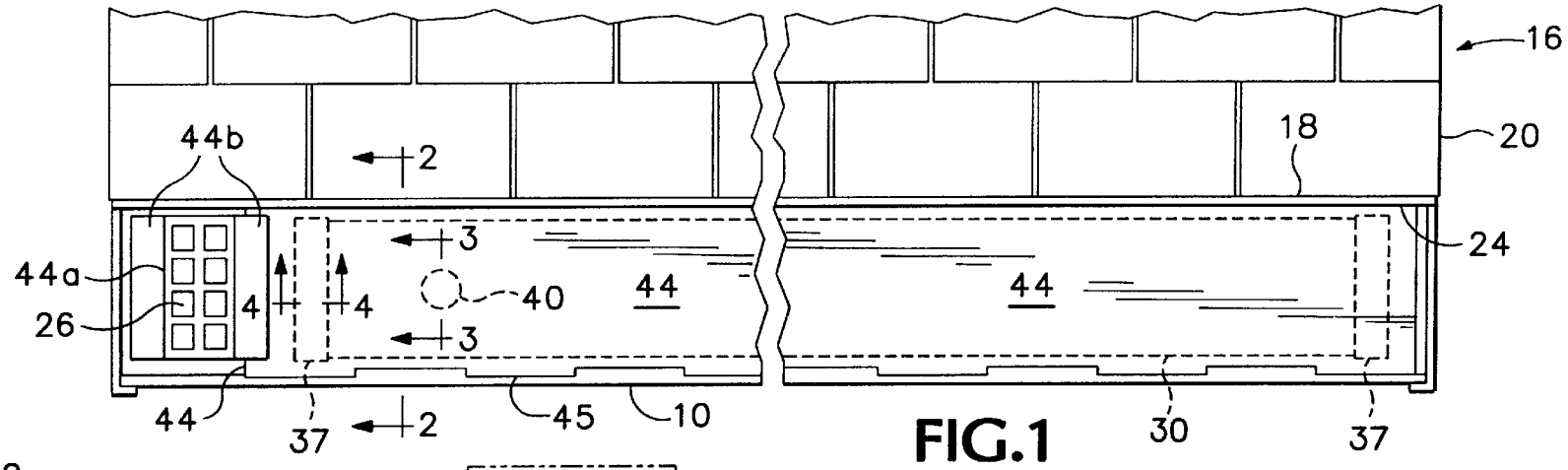
FIG. 1 is an extended top view of an exemplary embodiment of the invention.
Figure 2:
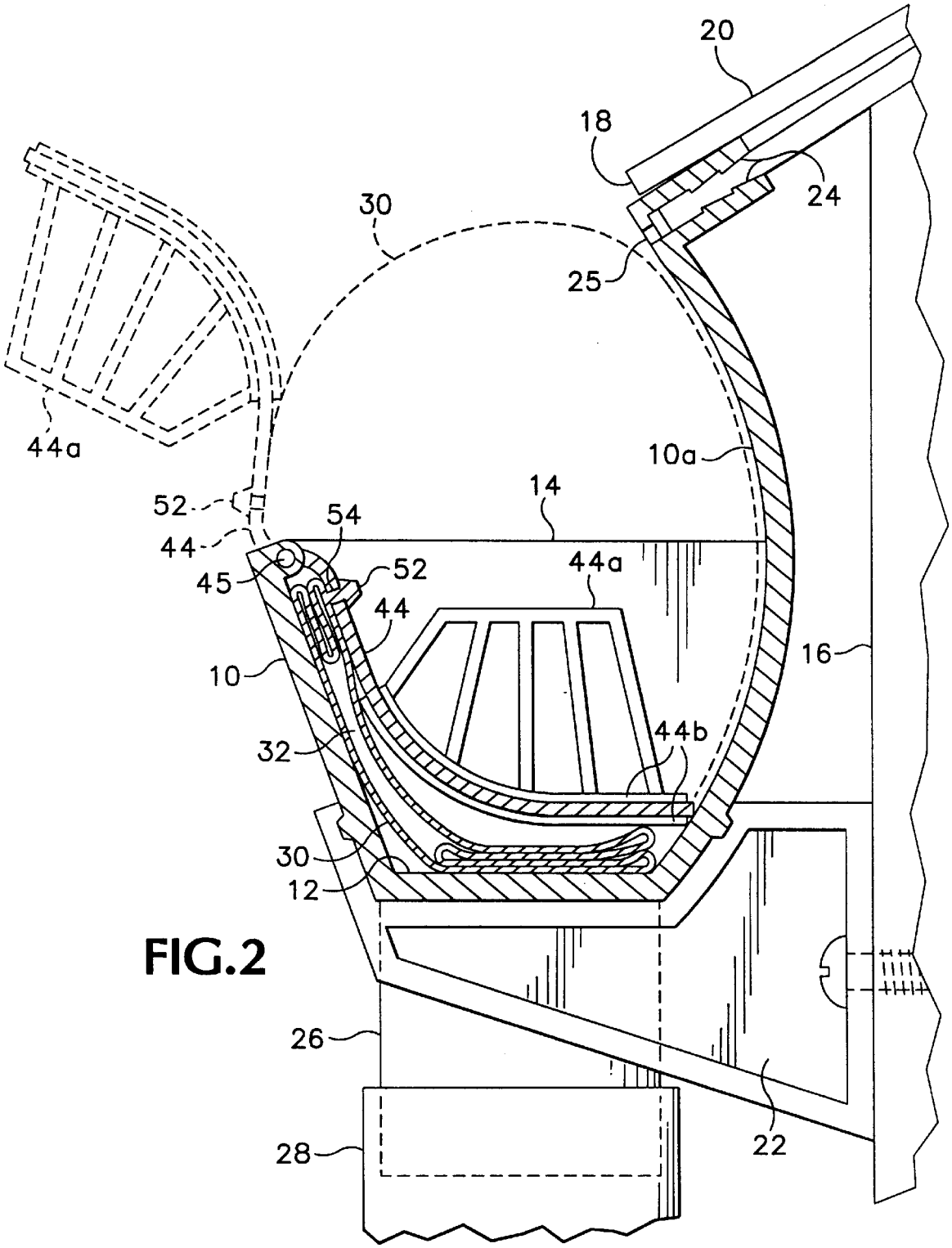
FIG. 2 is an enlarged cross-sectional view taken along line 2—2 of FIG. 1.

With reference to FIGS. 1 and 2, an elongate roof gutter 10 having a channel-shaped cross-section defining an interior bottom surface 12 and a top 14 is mounted on a building 16 below the overhanging edge 18 of a roof 20. The gutter 10 may be mounted to the building 16 by any suitable means, preferably by respective longitudinally-spaced snap-on bottom supports such as 22. The inside lip of the gutter includes an elongate jaw 24 for gripping the edge of the lower shingle layer along the length of the gutter. Any water entering the interior of the jaw 24 is drained into the gutter through apertures 25 spaced along the length of the gutter. The supports such as 22 can be provided in different lengths or with length-varying shims to accommodate different roof overhang dimensions.

The interior bottom surface 12 of the gutter has a drain 26 at one end which connects to a downspout 28 for conducting water from the gutter downwardly toward ground level.

A selectively inflatable/deflatable bladder 30 is installed on the interior bottom surface 12 in a deflated condition so as to extend longitudinally along the gutter. As shown in FIG. 2, the bladder preferably has inwardly-folding pleated sidewalls which collapse when the bladder is deflated. The interior chamber 32 of the bladder is selectively inflatable in response to infusion of a fluid into the chamber, thereby inflating the bladder toward the top of the gutter so that it assumes a configuration, such as that shown in dotted lines in FIG. 2, protruding from the top 14 of the gutter. The bladder 30 can be constructed of any flexible fluid-impervious material such as plastic, rubber, or fabric, or a composite of two or more such materials.

Figure 4:
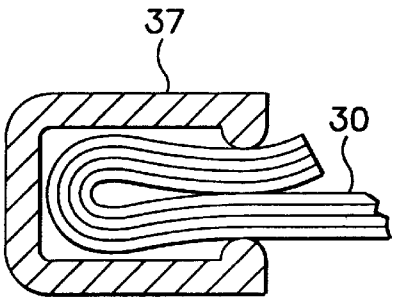
FIG. 4 is an enlarged partial sectional view taken along line 4—4 of FIG. 1.

The material of the bladder 30 is preferably originally furnished in long tubular lengths which exceed the expected lengths of the gutters in which the material is to be installed. This enables the installer to cut the bladder material to a length, such as shown in FIG. 1, which extends longitudinally along the entire length of a gutter except for the area of the drain 26, so that the drain remains unobstructed by the bladder. Resilient elongate metal or plastic clamps 37, spanning the width of the collapsed bladder material, can be used to seal the previously-cut ends of the bladder by folding the ends double and applying the clamps to the folded ends as shown in FIG. 4.

As an alternative to the single continuous elongate bladder 30 shown in FIG. 1, multiple bladders could, in accordance with the present invention, be distributed discontinuously along the gutter with respective interior chambers interconnected in series or in parallel by fluid conduits. Such multiple, shorter bladders could be employed in variable numbers in each gutter depending upon the gutter's length.

Figure 3:
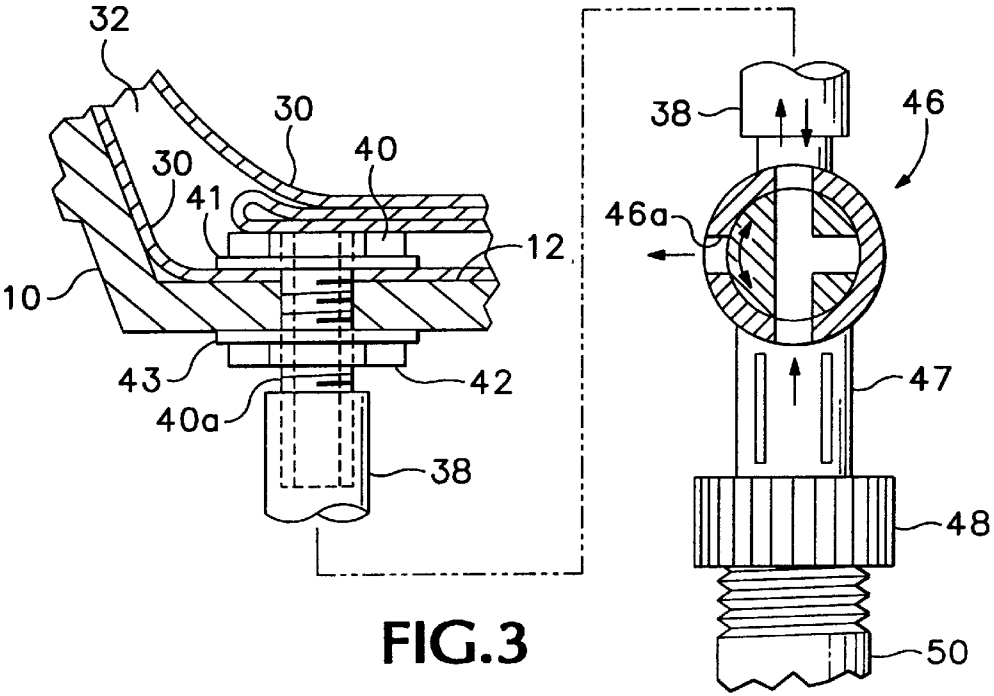
FIG. 3 is an enlarged partial sectional view taken along line 3—3 of FIG. 1, also showing attached fluid supply components.

In order to selectively inflate or deflate the bladder 30, a flexible fluid conduit such as a plastic tube 38 is connected to the interior chamber 32 of the bladder adjacent one end as shown in FIG. 3. A metal or plastic fluid coupling 40 having a fluid passageway therethrough has a lower threaded nipple 40*a*. Prior to clamping the adjacent end of the bladder, the installer forms aligned holes through the bottom of the bladder 30 and the bottom of the gutter 10 and inserts the threaded nipple 40*a* downwardly from the interior chamber 32 of the bladder through a washer 41 and through the aligned holes. The installer then slips a mating washer 43 over the bottom of the nipple 40*a* and applies a threaded nut 42 tightly to the nipple 40*a,* thereby sealing the hole in the bottom of the bladder by clamping its surrounding material tightly beneath the top of the coupling 40. The adjacent end of the bladder 30 is then clamped by a clamp 37. The conduit 38 is pushed tightly onto the nipple 40*a* and clamped to it, thereby completing the connection between the conduit 38 and the interior chamber 32.

The fluid conduit 38 extends downwardly from the gutter 10 to a location remote from the gutter where an actuating valve assembly, consisting of a selectively openable and closable fluid valve 46 and pressure reducer valve 47, are interposed in the conduit 38 near ground level. The valve assembly has a garden hose swivel coupling 48 for accepting the threaded insertion of a standard garden hose 50. The pressure reducer valve 47 preferably reduces the normal domestic water pressure to between 5 and 15 psi. A standard anti-siphon valve (not shown) can be connected at the opposite end of the garden hose 50 if desired.

Although it is within the scope of the invention to rely solely on the bladder 30 to collect and lift debris out of the top of the gutter, such process is performed more effectively by the inclusion of a separate debris-collecting and -lifting element, preferably in the form of an elongate plate 44 of concave cross-section. The plate 44 extends along the length of the gutter except for the area of the drain 26, and is pivotally attached by an elongate hinge 45 to the outside lip of the gutter.

An inverted, cup-shaped, fluid-permeable plastic screening member 44*a* is tightly attached by a slotted jaw 44*b* to one end of the plate 44 in a location above the drain 26 so as to permit normal drainage from the gutter into the drain through the screening member 44*a* while preventing the passage of larger particles of debris into the drain 26 and downspout 28. When the bladder 30 is inflated toward the top of the gutter as described previously, the bladder lifts the entire plate 44 and debris-screening member 44*a* pivotally upward to a substantially inverted position such as shown in dotted lines in FIG. 2, so that the debris on the plate and screening member is lifted and dumped over the outside wall of the gutter along its entire length. The inside wall 10*a* of the gutter has a radius of curvature matching the hinged pivoting radius of the plate 44, thereby guiding the plate 44 and bladder away from interference with the roof edge 18 during inflation, while also preventing any debris from being trapped beneath the roof overhang.

If the drain 26 is located at the opposite end of the gutter, the opposite jaw 44*b* (FIG. 1) of the screening member 44*a* is used to attach the screening member to the opposite end of the plate 44.

In use, a self-cleaning roof gutter system of the type just described is preferably installed as a complete new gutter installation. Alternatively, an existing gutter could be retrofitted to perform the self-cleaning function by inserting a liner, shaped like the gutter 10, into the existing gutter, removing any existing gutter mounting hardware traversing the top of the gutter which would interfere with the operation of the cleaning system and substituting bottom mounting hardware similar to support 22 shown in FIG. 2.

Debris collects above the deflated bladder in the gutter's normal course of operation. Debris also can be expected to collect in especially heavy concentrations on the debris-screening member 44*a*. When it is desired to clean the gutter, a garden hose such as 50 is attached to the coupling 48 at the bottom of the conduit 38. The actuating valve 46 is moved to its open position as shown in FIG. 3 and water is infused from the garden hose 50 through the conduit 38 into the bladder's interior chamber 32. When the bladder is fully inflated, all of the debris above the bladder will have been lifted and dumped from the top of the gutter, together with the debris on the screening member 44*a*. When the debris has been dumped, the valve 46 is rotated 90° counterclockwise (as seen in FIG. 3) to its closed position which prevents the further infusion of water from the garden hose 50 while permitting drainage of the conduit 38 by gravity through a drain port 46*a*. The resultant loss of pressure in the conduit 38 creates a siphoning effect so that the water in the chamber 32 is quickly drained and the bladder is deflated completely by atmospheric pressure to its normal collapsed condition. If the outward extremity of pivoted movement of the plate 44 is limited by the hinge 45 so that the plate's center of gravity remains inboard of the hinge pivot axis, the plate 44 will return to its normal downward position by gravity when the bladder deflates. Preferably, however, the pivoting movement is not so limited in order to maximize the outward dumping motion of the plate 44 by enabling the plate to be inverted as shown in FIG. 2. In such case, longitudinally spaced snap-in connectors such as 52 (FIG. 2), between the top of the bladder 30 and apertures 54 formed in the plate 44, force the downward return of the plate 44 when the bladder is deflated, while also positively maintaining the bladder in its proper position in the gutter despite repeated inflations and deflations. Alternatively, return springs could force the downward return of the plate 44, and the bottom of the bladder could be adhered or otherwise connected to the gutter to maintain it in its proper position if necessary.

All of the components of the system are preferably constructed of an opaque, corrosion-resistant material, preferably flexible plastic of low elasticity in the case of the bladder material and conduit 38, and relatively rigid metal or plastic for the other components. Although the control valve 46 is shown as being manually operated, it could instead be solenoid-operated with multiple such valves all connected to a common electrical controller so that all of the gutter-cleaning units on a particular building can be operated remotely from a single location, either manually or by automatic timed operation.

Instead of a curved inside wall 10*a,* the inside wall could be straight and inclined parallel to the outside wall, in which case a bladder could be used without the pivotal plate 44, or with an upwardly slidable plate mounted atop the bladder.

Instead of a bladder, other means could be used for pivoting the plate 44, such as a simple fluid piston or motor in which case the bladder 30 could be eliminated.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A remotely-controllable self-cleaning roof gutter system comprising:

(a) an elongate roof gutter having a top;

(b) at least one bladder within said gutter, said bladder having an interior chamber and being inflatable so as to lift debris within said gutter toward said top of said gutter in response to infusion of a fluid into said interior chamber of said bladder;

(c) a fluid infusion conduit connected to said interior chamber of said bladder and extending therefrom to a location remote from said gutter; and (d) a debris-collecting element, separate from said bladder, movably mounted within said gutter so as to be liftable by said bladder toward said top of said gutter in response to infusion of said fluid into said interior chamber of said bladder.

2. The system of claim 1 wherein said fluid infusion conduit extends downwardly from said gutter to said location.

3. The system of claim 1, including a selectively openable and closable fluid valve assembly interposed in said fluid conduit at said location, said valve assembly infusing said fluid through said conduit into said interior chamber of said bladder when open, and siphoning said fluid from said interior chamber of said bladder when closed.

4. The system of claim 1, including a pressure-reducing valve which reduces the pressure of said fluid infused into said interior chamber of said bladder.

5. The system of claim 1 wherein said debris-collecting element is pivotally mounted within said gutter so as to be pivotally liftable by said bladder.

6. The system of claim 1 wherein said debris-collecting element is movably mounted within said gutter so as to be liftably invertable by said bladder in response to infusion of said fluid into said interior chamber of said bladder.

7. The system of claim 1, further including a wall member extending upwardly from said gutter and attachable to an edge of a roof overhanging said gutter so as to prevent interference between said debris-collecting element and said edge of said roof during lifting of said element.

8. A remotely-controllable self-cleaning roof gutter system comprising:

(a) an elongate roof gutter having a top;

(b) at least one bladder within said gutter, said bladder having an interior chamber and being inflatable so as to lift debris within said gutter toward said top of said gutter in response to infusion of a fluid into said interior chamber of said bladder;

(c) a fluid infusion conduit connected to said interior chamber of said bladder and extending therefrom to a location remote from said gutter; and (d) a wall member extending upwardly from said gutter and attachable to an edge of a roof overhanging said gutter so as to prevent interference between said bladder and said edge of said roof during inflation of said bladder.

9. A remotely-controllable self-cleaning roof gutter system comprising:

(a) an elongate roof cutter having a top and including a drain;

(b) at least one bladder within said gutter, said bladder having an interior chamber and being inflatable so as to lift debris within said gutter toward said top of said cutter in response to infusion of a fluid into said interior chamber of said bladder;

(c) a fluid infusion conduit connected to said interior chamber of said bladder and extending therefrom to a location remote from said gutter; and (d) a fluid-permeable debris-screening member movably mounted within said gutter at a location above said drain so as to be liftable by said bladder toward said top of said gutter in response to infusion of said fluid into said interior chamber of said bladder.

10. A remotely-controllable self-cleaning roof gutter system comprising:

(a) an elongate roof gutter having a top;

(b) at least one debris-collecting element movably mounted within said cutter so as to be selectively liftable toward said top of said gutter in response to actuation from a location remote from said gutter; and (c) a wall member extending upwardly from said gutter and attachable to an edge of a roof overhanging said gutter so as to prevent interference between said debris-collecting element and said edge of said roof during lifting of said element.

11. The system of claim 10 wherein said debris-collecting element is pivotally mounted within said gutter so as to be pivotally liftable.

12. The system of claim 10 wherein said debris-collecting element is movably mounted within said gutter so as to be liftably invertable.

13. The system of claim 10, further including at least one bladder within said gutter, said bladder being selectively inflatable so as to lift said debris-collecting element.

14. A method of cleaning debris from a roof gutter having a top and a debris-collecting element movably mounted on said gutter, wherein an edge of a roof overhangs said gutter, said method comprising:

(a) lifting said debris-collecting element toward said top of said gutter and thereby lifting said debris toward said top of said gutter while actuating said lifting of said element from a location remote from said gutter;

(b) while said debris-collecting element is lifted and remains mounted on said gutter, removing said debris therefrom; and (c) preventing interference between said debris-collecting element and said edge of said roof, while said debris-collecting element is being lifted, by inserting a wall member between said edge of said roof and said debris-collecting element.

15. The method of claim 14 including providing at least one bladder within said gutter and lifting said debris-collecting element by inflating said bladder.

16. The method of claim 14, including pivotally lifting said debris-collecting element.

17. The method of claim 14, further including inverting said debris-collecting element by said lifting of said element.

18. The method of claim 14 wherein said gutter includes a drain, further including mounting a fluid-permeable debris-screening member in a location above said drain and lifting said screening member toward said top of said gutter while simultaneously lifting said debris-collecting element.

* * * * *